US005412374A

United States Patent [19]

Clinton

[11] Patent Number: 5,412,374

[45] Date of Patent: May 2, 1995

[54] METHOD AND APPARATUS FOR DETECTING AND INDICATING THE LOCATION OF A HIGH TEMPERATURE ZONE ALONG THE LENGTH OF A FIRE DETECTING CABLE

[76] Inventor: Henry H. Clinton, 10 Shore Rd., Clinton, Conn. 06413

[21] Appl. No.: 248,374

[22] Filed: May 24, 1994

[51] Int. Cl.[6] ..... G08B 17/00

[52] U.S. Cl. ..... 340/584; 340/596

[58] Field of Search ..... 340/584, 596; 338/26; 374/183, 185

[56] References Cited

U.S. PATENT DOCUMENTS 4,361,799 11/1982 Lutz ..... 338/26

5,185,594 2/1993 DeChurch ..... 340/596

*Primary Examiner*—John K. Peng

*Assistant Examiner*—Benjamin C. Lee

*Attorney, Agent, or Firm*—McCormick, Paulding & Huber

[57] ABSTRACT

A method and related apparatus for sensing and indicating the location of a "hot spot" along a temperature sensing cable utilizes a linear stable voltage feedback loop circuit for maintaining a predetermined magnitude DC voltage across one conductor of a pair of conductors having electrically insulating jacket compositions which become electrically conductive when the temperature at any location along the surface exceeds a predetermined temperature wherein the voltage measurement is a direct indication of the distance from the NEAR END of the temperature sensing cable to the "hot spot".

10 Claims, 2 Drawing Sheets

METHOD AND APPARATUS FOR DETECTING AND INDICATING THE LOCATION OF A HIGH TEMPERATURE ZONE ALONG THE LENGTH OF A FIRE DETECTING CABLE

BACKGROUND OF THE INVENTION

The present invention relates generally to fire alarm systems and deals more particularly with an improved method and apparatus for determining the location of a high temperature zone along the length of the fire detecting cable.

It is known in the art of fire alarm systems to utilize a special electrical cable typically made of two conductors which produce a short circuit between one another wherever the insulation of the conductors melts as a result of the cable being heated or overheated, for example by a fire, at some point along the length of the cable. Various means are known for producing a short circuit between the conductors of such a cable, for example, semi-conductor devices designed for such operation are placed at spaced intervals along the cable and become conductive when exposed to heat such as heat produced during a fire condition. The location of the short circuit is then determined by measuring the resistance between the ends of the conductors at one end of the cable. Since the resistance per unit length of the conductors is generally known, the value of the measured resistance may be used to provide a determination of the distance along the cable to the location of the short circuit. One such typical prior art method and apparatus is shown as an electrical schematic representation in FIG. 1.

The accuracy of the determined location of the short circuit using the above known method and associated apparatus is generally poor because the resistance of the conductors varies with changes in ambient temperature and further because the short circuit itself may present an electrical resistance which contributes to the overall resistance measurement thus leading to an erroneous determination of the location of a high temperature zone.

Furthermore, the above known method and associated apparatus is unsuitable for use with a new class of fire detecting or temperature sensing cable which does not physically short circuit between conductors but rather has insulation which has a composition which establishes a conduction path between the conductors at elevated temperatures. Such temperature sensing cable is disclosed, for example, in U.S. Pat. No. 5,185,594.

It is an aim of the present invention therefore to overcome the above limitations by providing an improved method and associated apparatus to determine the distance from one end of a fire detecting or temperature sensing cable to the point of the short circuit established between conductors at elevated temperatures with greater accuracy than that provided by resistance measurement or time domain reflectometry.

It is a further aim of the present invention to maintain the improved accuracy in the determination of the distance from one end of the fire detecting cable to the point of the elevated temperature along the cable regardless of the resistance added by the short circuit producing means itself, and regardless of any resistance variation in the conductors of the fire detecting or temperature sensing cable due to ambient temperature changes.

It is a yet further aim of the present invention to provide a method and related apparatus which operates with fire detecting or temperature sensing cable having insulation which becomes electrically conductive at high temperatures to permit a greater degree of sensitivity and accordingly, the ability to detect fires or overheat locations earlier than might otherwise be possible using known methods and associated apparatus.

SUMMARY OF THE INVENTION

A method and apparatus for sensing and indicating the location of a "hot spot" along the length of a temperature sensing cable of the type having two conductors covered with an electrically insulating jacket having a composition which becomes electrically conductive when the temperature of the insulating jacket at any location along its surface exceeds a predetermined temperature and further having two longitudinally extending spaced apart conductors each of which is covered with a non-conducting electrical insulating jacket wherein each of the conductors is of substantially identical length with one end of each conductor being defined as the NEAR END and the opposite end of each conductor being defined as the FAR END is presented in accordance with the present invention. A linear stable voltage feedback loop circuit has its input coupled to the NEAR END of the temperature sensing cable and an output coupled to the FAR END of the temperature sensing cable for maintaining a predetermined magnitude DC voltage potential between the NEAR END and FAR END of one of the electrically conductive insulating jacket conductors. Voltage measurement means such as a DVM is coupled to the NEAR END end of the second one of the electrically conductive insulating jacket conductors of the cable means and senses and measures a voltage potential developed between the NEAR END end of the first one of the electrically conductive insulating jacket conductors and the "hot spot" when temperature exceeds the predetermined temperature to establish a conduction path between the conductors at the "hot spot" whereby the proportionality of the measured voltage to the predetermined magnitude of the DC voltage reference potential maintained between the NEAR END end and FAR END end of the electrically conductive insulating jacket conductor is directly indicative of the distance along the temperature sensing cable from the NEAR END to the location of the hot spot.

The invention further lies in a related method for sensing and indicating the location of a "hot spot" along the length of the temperature sensing cable.

BRIEF DESCRIPTION OF THE DRAWINGS

Other features and advantages of the present invention will become apparent from the following written description and drawings wherein.

WRITTEN DESCRIPTION OF PREFERRED EMBODIMENTS

Figure 1:
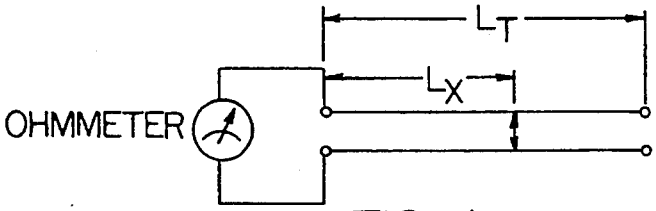
FIG. 1 PRIOR ART
FIG. 1 is an electrical schematic representation of a fire detecting cable and prior art method to determine the location of a short circuit.
Figure 2:
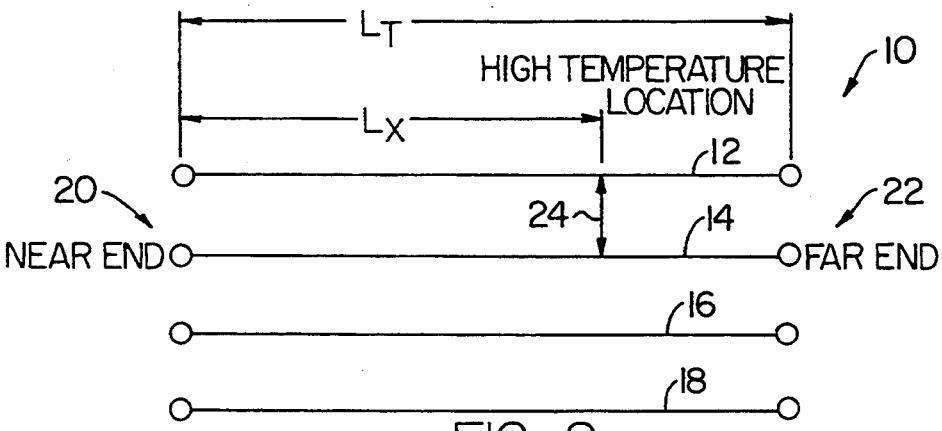
FIG. 2 is an electrical schematic representation of a fire detecting or temperature sensing cable of the type having two temperature dependent electrically conductive insulated longitudinal conductors and two conventionally insulated longitudinal conductors.

Turning now to the drawings and considering the detecting and distance indicating apparatus of the present invention in further detail, FIG. 2 is an electrical schematic representation of a fire detecting cable of the type having four conductors and is generally designated 10. The cable 10 includes two conductors 12, 14 which are insulated from one another with an insulation material having a characteristic such that the insulation separating the conductors becomes electrically conductive at any location along the length of the conductors where the temperature has been raised sufficiently high to cause a change in the resistance of the insulation. From a practical standpoint, the resistance of the insulation between the conductors can be considered to present an infinite impedance or resistance. As the temperature along the cable rises, typically as the temperature approaches the melting point of the insulation, the resistance of the insulation begins to change and may be, for example, 1000 Megohms. The resistance characteristic of the insulation at or near the melting point temperature of the insulation material is such that the resistance properties of the insulation material follows a steep slope and the magnitude of the resistance drops rapidly. Such temperature dependent electrically conductive insulated conductor type cable is disclosed in the above referenced U.S. Pat. No. 5,185,594.

The cable 10 also includes two additional conductors 16, 18 which are electrically insulated from one another and from the conductors 12, 14 wherein the conductors 16, 18 use conventional and, preferably, fire retardant insulation. As illustrated in FIG. 2, the cable 10 is made up of the parallel conductors 12,14,16,18 and has an overall length designated LT. For purposes of this disclosure, the cable 10 has one respective end designated NEAR END 20 and a respective other end designated FAR END 22. In FIG. 2 the illustrated location of current conduction between the insulated conductors 12,14 is shown as a resistance or current conduction path 24 and represents a location of sufficiently high temperature to cause conduction between the insulated conductors 12,14 at a distance LX as measured from the NEAR END 20.

Figure 3:
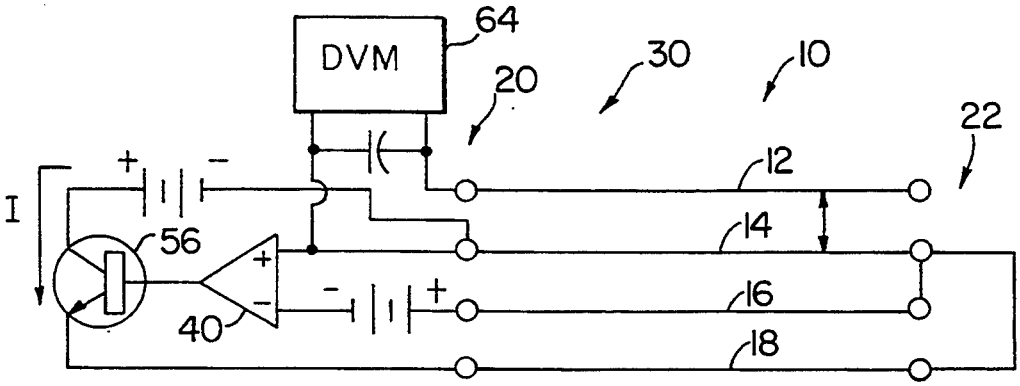
FIG. 3 is an electrical schematic representation of one embodiment of the detecting apparatus of the present invention shown connected to the four conductor fire detecting cable of FIG. 2.
Figure 4:
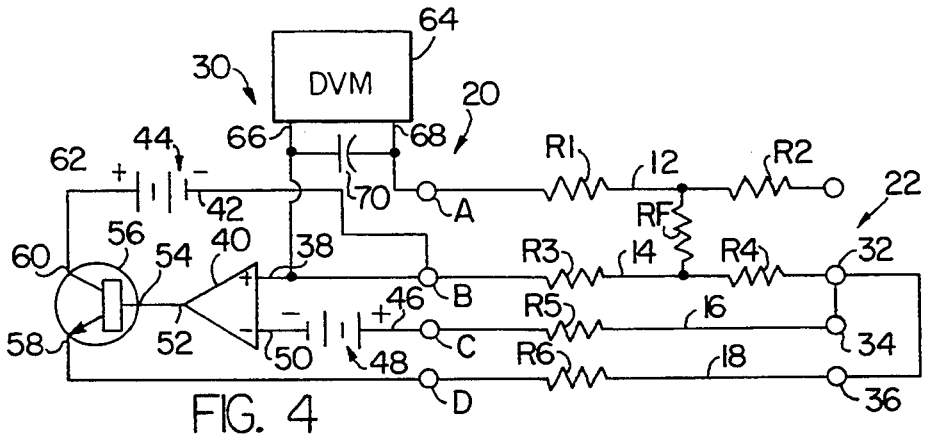
FIG. 4 presents the detecting apparatus of FIG. 3 showing lumped resistance equivalents for each conductor of the fire detecting cable.

One embodiment of a fundamental circuit design of the detecting apparatus of the present invention and which apparatus is generally designated 30 is shown in FIGS. 3 and 4 connected to a four conductor fire detecting or temperature sensing cable such as shown in FIG. 2. Referring to FIG. 4, the conductors or respective segments of the conductors are shown as resistance elements. The conductor 12 is represented at either side of a location of high temperature by series resistance elements R1 and R2, and the conductor 14 is represented at either side of the location of the high temperature by series resistance elements R3 and R4 with the resistance or current conduction path 24 between the conductors 12 and 14 at the location of high temperature being represented by the resistance element RF. The resistance element RF is electrically represented as a connection between the junction of resistance elements R1 and R2 and the junction of resistance elements R3 and R4. The conductor 16 is represented by the resistance element R5 and the conductor 18 is represented by the resistance element R6.

The four conductor fire detecting cable 10 is connected to the detecting apparatus 30 at the NEAR END 20 such that the one end B of the resistance element R3 is connected to the non-inverting input 38 of operational amplifier 40 and to the negative voltage potential side 42 of a DC voltage power source 44. One end C of the resistance element R5 at the NEAR END 20 of the fire detecting cable 10 is connected to the positive side 46 of a DC voltage reference potential power source 48 which power source is in series with the inverting input 50 of the operational amplifier 40. The output 52 of the operational amplifier 40 is connected to the base terminal 54 of an NPN transistor 56. The emitter terminal 58 of the NPN transistor 56 is connected to the end D of the resistance element R6 at the NEAR END 20 of the fire detecting cable 10. The collector terminal 60 of the NPN transistor 56 is connected to the positive voltage potential side 62 of the DC voltage power source 44. The DC voltage power source 44 is connected in series with the collector terminal 60 and the non-inverting input 38 of the operational amplifier 40. One end 32 of the resistance element R4 at the FAR END 22 of the fire detecting cable 10 is connected to one end 34 of the resistance element R5 and to one end 36 of the resistance element R6 at the FAR END 22 of the fire detecting cable 10.

The circuit is designed and configured as a linear stable voltage feedback loop to maintain the sum of the voltage drops across resistance elements R3 and R4 substantially equal to the magnitude of the DC voltage reference power source 48. In operation, an electric current I having a magnitude as required is supplied from the DC voltage power source 44 and is conducted through the NPN transistor 56 configured as a DC linear amplifier, through the resistance element R6 (conductor 18), through the resistance element R4 and R3 (conductor 14), returning to the negative voltage potential side 42 of the DC voltage power source 44 and the non-inverting input 38 of the operational amplifier 40. At quiescent state, the voltage potential at the output 52 of the operational amplifier 40 causes the NPN transistor 56 into conduction to keep the voltage drop developed across the conductor 14 (VR3+VR4) equal to the magnitude of the DC voltage reference power source 48. In order to easily calculate the length along the cable, the magnitude of the DC voltage reference power source 48 is set to provide a value of 1 millivolt per foot of the length of the conductor 14 to provide a convenience direct reading range by a digital-voltmeter as disclosed in further detail below.

A digital-volt-meter (DVM) generally designated 64 has one input 66 connected to the positive input terminal 38 of the operational amplifier 40 and has its other input 68 connected to one end A of the resistance element R1 at the NEAR END 20 of the fire detecting cable 10. A capacitor element 70 is placed in parallel with the input terminals 66,68 of the DVM. The capacitor 70 shunts the input of the DVM and serves as a low pass filter to minimize the effects of any stray AC fields which may be picked up by the fire detecting cable 10. The input impedance of the operational amplifier is very high and effectively presents an open circuit to the input of the DVM and the voltage potential measured by the DVM will be the voltage drop developed across the resistance element R3. For convience of reading the DVM directly to obtain distance and, for purposes of example, the resistance of the conductor 14 (R3+R4) is presumed to be 1 ohm and the length of the cable to be 100 feet. This requires in this example that the magnitude of the DC voltage reference power source 48 be set at 100 millivolts. The current I from the DC voltage power source 44 and conducted by the NPN transistor 56 will then be 100 milliamperes. Any variation in resistance of the conductor is compensated for by the feedback loop which causes the NPN transistor to provide more or less current so that the sum of the voltage drops around the loop is forced to zero, that is, made substantially equal to the magnitude of the DC voltage power source 48. The magnitude of the current I in the circuit design selected should further be sufficiently high to permit conventional sensitivity measurement equipment to be utilized for measurements.

Continuing the example, if a hot temperature condition or "hot spot" is present along the cable to cause conduction between conductors as represented by the resistance element RF, the resistance RF will drop rapidly. A reading will not be made by the DVM until a threshold value is reached at which time the measurement equipment will detect and measure current. Typically this threshold value is 10 Megohms. In the present example, the DVM will start to measure when the magnitude of resistance element RF reaches approximately 10 Megohms. The voltage developed across resistance element R3 is proportional to the ohmic values of resistance elements R3 and R4 and the voltage across the resistance element R3, in this case in millivolts, is read by the DVM with each millivolt signifying and representing one foot in length of the cable. If the reading is 50 millivolts, for example, the location of the "hot spot" is taken to be 50 feet from the NEAR END 20 of the cable.

It will be apparent that a simple mathematical calculation will be necessary to determine the distance LX to the "hot spot" when the magnitude of the voltage potential of the DC voltage reference potential power source is set to provide other than a reading of 1 millivolt per foot of length of the conductor 14.

The DVM is selected to have an input resistance of at least 100 times the maximum resistance of resistance element RF which is measured at the location of the high temperature. Therefore, the voltage potential as measured at the NEAR END 20 of the fire detecting cable 10 between the respective ends A,B of the resistance elements R1 and R3 (the respective ends of the conductors 12 and 14 at the near end) will be a maximum of 1% less than the voltage potential developed across the resistance element R3 which represents the ohmic resistance of the conductor 14 between the NEAR END 20 and the location of the high temperature point along the cable. Because the resistance is proportional to length to an extremely high degree of accuracy, the measurement of the developed voltage potential by the DVM in millivolts will accurately indicate the distance directly in feet from the NEAR END 20 of the fire detecting cable 10 to the location of the high temperature.

The voltage measurement instrument, DVM or other suitable measurement device for use with the detecting apparatus circuitry as disclosed above, preferable has a reading retention capability. To more accurately pinpoint the location of the "hot spot" along the cable, a timed period for reading the measured voltage at the cable is taken to allow the value of the resistance element RF to decrease from the initial reading when RF is about 10 Megohms. At the end of a predetermined time interval, approximately one minute, the measurement device or DVM is locked or operated to a "freeze mode" to retain the reading and the DVM is generally disabled. Any subsequent readings will prove to likely be erroneous since the source of the "hot spot" (generally produced from a fire at the location) will be spreading and result in readings which identify a location other than the location of the origin of the fire.

Figure 5:
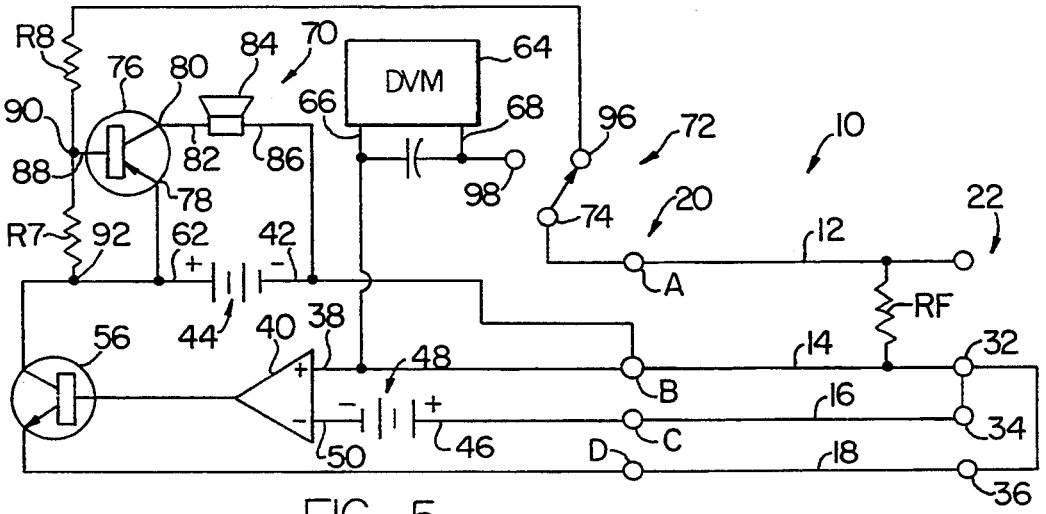
FIG. 5 is an electrical schematic representation of one embodiment of an alarm circuit utilizing the detecting apparatus of FIG. 3.

Turning now to FIG. 5, the detecting apparatus 30 shown in FIG. 4 is modified to include an alarm circuit generally designated 70. A single pole, single throw switch 72 has its transfer contact 74 connected to the end A of the conductor 12 at the NEAR END 20 of the fire detecting cable 10. The transfer contact 74 is used to select between the alarm circuit 70 and the one input 68 of the DVM 64. The alarm circuit 70 comprises a PNP transistor 76 having its emitter terminal 78 connected to the positive voltage potential side 62 of the DC voltage potential power source 44. The collector terminal 80 of the PNP transistor 76 is connected to one terminal 82 of a speaker or other suitable audio emitting device or transducer 84 with the other terminal 86 of the speaker 84 being connected to the negative voltage potential side 42 of the DC voltage potential power source 44. The base terminal 88 of the PNP transistor 76 is connected to the junction 90 of series resistance elements R7 and R8 wherein one end 92 of resistance element R7 is connected to the positive side 62 of the DC voltage potential power source 44 and the end 94 of resistance element R8 is connected to one contact 96 of the switch 72. When the switch 72 is operated to the alarm circuit operative position that is, the transfer contact 74 is connected to contact 96, the PNP transistor 76 is normally in a non-conductive state in the absence of a high temperature condition. When a high temperature condition occurs along the fire detecting cable 10, the ohmic resistance between the conductors 12 and 14 designated as resistance element RF drops below a predetermined threshold value (recalling that the insulation of the conductors 12 and 14 carry current as temperature rises above the predetermined temperature), the PNP transistor 76 becomes conductive and supplies current to the audible alarm or speaker 84 causing it to emit an audible sound. When the alarm sounds, an operator can operate the switch 72 to its operative measurement position to connect the end A of the conductor 12 to the contact 98 of the switch 72 through the transfer contact 74 and to the input 68 of the DVM to obtain a reading directly indicating the distance from the NEAR END to the high temperature location.

Figure 6:
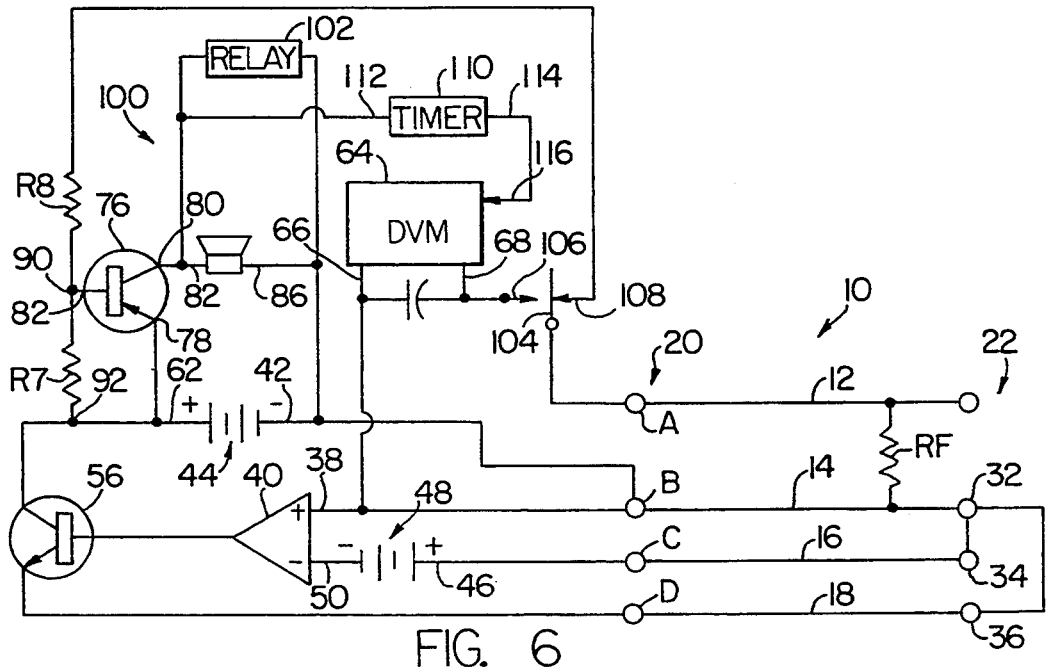
FIG. 6 is an electrical schematic representation of an alternate embodiment of an alarm circuit utilizing the detecting apparatus of FIG. 3.

FIG. 6 shows an alternate embodiment of an alarm circuit generally designated 100 which may be utilized with the detecting apparatus 30 of the present invention. The alarm circuit 100 of FIG. 6 provides an automatic transfer of the NEAR END end A of conductor 12 of the fire detecting cable 10. The alarm circuit 100 of FIG. 6 allows an operator to be absent or away from the alarm circuit and detecting apparatus at the time of occurrence of a "hot spot" along the fire detecting cable and to still provide a reading by the DVM after the predetermined time delay from the start of detection and the initial sounding of the audible alarm. Once the reading is made and frozen in, an operator can return, even if the fire detecting cable has been destroyed, and observe the reading on the DVM which is directly indicative of the distance of the location of the "hot spot" from the NEAR END. The operation of the detecting apparatus and alarm circuit of FIG. 6 is substantially equivalent to the operation discussed in connection with FIG. 5 with the exception that a relay 102 and transfer 104 have replaced the switch 72. The transfer 104 has a normally open (NO) contact 106 and normally closed (NC) contact 108 to transfer the NEAR END end A of the conductor 12 from its NC connection to the resistor R8 of the alarm circuit 100. When a conduction path is established, the alarm circuit detects the conduction path and operates as described above to sound the alarm. In FIG. 6 however, the relay 102 is also connected to the collector terminal 80 of the transistor 76 and is operated when the transistor begins to conduct current. When the relay 102 operates, the NEAR END end A of the conductor is transferred by the transfer 104 to close the NO contact 106 to connect the input terminal 68 of the DVM 64 to the NEAR END end A to begin to read the voltage between the ends A and B of the conductors 12 and 14 respectively. A timer circuit 110 of any well known design has an input 112 connected to the collector terminal 80 of the transistor 76 and is activated at the time the alarm circuit detects the conduction path. The timer 110 is set to provide a predetermined interval of approximately 1 minute to allow sufficient time for the resistance of the conduction path to drop to insure a reliable reading. At the end of the time interval, the timer 110 provides an output signal at its output 114 which is connected to the "data hold" or "freeze mode" input 116 of the DVM 64 to disable the DVM reading cycle. Thus, a reading is automatically made and held at the proper time even in the absence of an operator. This feature allows the reading caused by the initial "hot spot" to be held even in the event of a spreading fire or destruction of the fire detecting cable.

Apparatus for detecting and indicating the location of a high temperature zone along the length of a fire detecting cable has been disclosed above. Numerous changes and modifications are possible through the selection of different circuit components to achieve the intended results and therefore the invention has been disclosed by way of example rather than limitation.

The invention claimed:

1. Apparatus for sensing and indicating the location of a "hot spot" along the length of a temperature sensing cable means of the type having at least first and second longitudinally extending and spaced apart conductors covered with an electrically insulating jacket having a composition which exhibits a resistance element characteristic and becomes electrically conductive when the temperature of the insulating jacket at any location along its surface exceeds a predetermined temperature and, at least third and fourth longitudinally extending and spaced apart conductors each of which is covered with a non-conducting electrical insulating jacket wherein each of said conductors is of substantially identical length with one end of each conductor being defined as the NEAR END and the opposite end of each conductor being defined as the FAR END, said apparatus comprising:

electronic circuit means defining a linear stable voltage feedback loop having input means coupled to the NEAR END of the temperature sensing cable and having output means coupled to the FAR END of the temperature sensing cable for maintaining through said third and fourth conductors a predetermined magnitude DC voltage potential between the NEAR END end and the FAR END end of said first one of the electrically conductive insulating jacket conductors of said cable means;

a first DC voltage reference potential power source means for supplying said predetermined magnitude DC voltage potential, and voltage measurement means coupled to the NEAR END ends of the first and second ones of the electrically conductive insulating jacket conductors of said cable means for sensing and measuring a voltage potential developed between said NEAR END end of said first one of the electrically conductive insulating jacket conductors of said cable means and the "hot spot" when the temperature of the electrically conductive insulating jacket exceeds the predetermined temperature to establish a conduction path between the first and second conductors at the "hot spot" whereby the proportionality of the measured voltage to the predetermined magnitude of said DC voltage reference potential is directly indicative of the distance along said temperature sensing cable means from the NEAR END to the location of the "hot spot".

2. Apparatus as defined in claim 1 further comprising:

said linear stable feedback loop circuit means further including operational amplifier means having an inverting input, non-inverting input and an output wherein said non-inverting input is connected to the NEAR END end of said first one of the electrically conductive insulating jacket conductors of said cable means, said first DC voltage potential power source is connected between said inverting input and the NEAR END end of said third one of the non-conducting electrical insulating jacket conductors, said operational amplifier producing an output voltage signal in response to a voltage magnitude difference between said non-inverting and said inverting inputs, a linear DC current amplifier circuit means having a control input coupled to said output of said operational amplifier means;

a second DC voltage power source coupled to said linear DC current amplifier circuit means for supplying current to said linear DC current amplifier means in response to said operational amplifier output signal;

said linear DC current amplifier means having an output connected to the NEAR END end and through the FAR END end of said fourth one of the non-conducting electrically insulating jacket conductors for supplying an electrical current to the FAR END end of said first conductor having a magnitude directly proportional to said operational amplifier output voltage signal, the FAR END ends of said first and third ones of the electrically conductive insulating jacket conductors are connected whereby the sum of a voltage developed between the FAR END end and NEAR END end of said first one of the electrically conductive insulating jacket conductors and a voltage developed between the FAR END end and NEAR END end of said third one of the non-conducting electrically insulating jacket conductors and the predetermined magnitude DC voltage potential produced by said first DC voltage reference potential power source is substantially equal to zero to compensate for changes in resistance of said first and second ones of the electrically conductive insulating jacket conductors.

3. Apparatus as defined in claim 2 wherein said voltage measurement means further comprises a digital-volt-meter (DVM) having an input resistance of at least 100 times the resistance of the conduction path established between the first and second electrically conductive insulating jacket conductors when the predetermined temperature at any point along said temperature sensing cable is exceeded.

4. Apparatus as defined in claim 1 further comprising:

alarm circuit means having alarm circuit input means and output means wherein said input means is coupled to said NEAR END end of the first and second ones of the electrically conductive insulating jacket conductors for sensing a voltage signal produced as a result of the presence of said "hot spot" along the length of the temperature sensing cable;

relay means coupled to said alarm circuit output means and being responsive thereto and having a first operative position for connecting said alarm circuit means to said NEAR END end of the second one of the electrically insulating jacket conductors of said cable means and a second operative position for automatically transferring and connecting said voltage measurement means to said NEAR END end of the second one of the electrically insulating jacket conductors of said cable means in response to said alarm circuit output means producing a voltage signal to operate said relay from its first operative position to its second operative position, and timer circuit means having an input and an output wherein said input is coupled to said alarm circuit output means and is responsive to said alarm circuit output voltage signal for producing a voltage timing signal after a predetermined time interval, said voltage measurement means having a "freeze mode" input for activating a "data hold" operative condition for disabling said voltage measurement means to "freeze" a measurement reading at a time when said "data hold" operative condition is activated, said "freeze mode" input being coupled to said timer circuit output whereby additional measurement readings which would be displayed as a result of a spreading fire are prevented and the reading directly indicative of the distance along said temperature sensing cable means from the NEAR END to the location of the "hot spot" is retained.

5. Apparatus as defined in claim 4 wherein said alarm circuit means further includes transducer means coupled to said alarm circuit output means for producing an audible signal in response to the presence of said alarm circuit output voltage signal.

6. Apparatus as defined in claim 4 wherein said voltage measurement means further comprises a digital-volt-meter (DVM) having an input resistance of at least 100 times the resistance of the conduction path established between the first and second electrically conductive insulating jacket conductors when the predetermined temperature at any point along said temperature sensing cable is exceeded.

7. Apparatus as defined in claim 4 wherein said timer circuit means is set for a predetermined time interval approximately 1 minute.

8. Apparatus as defined in claim 1 further including:

alarm circuit means coupled to said NEAR END ends of the second ones of the electrically conductive insulating jacket conductors for producing an audible alarm in response to a predetermined voltage signal produced as a result of the presence of said "hot spot" along the length of the temperature sensing cable;

transfer switch means having a first operative position and a second operative position for selectively connecting said voltage measurement means and said alarm circuit means to said NEAR END end of the second one of the electrically conductive insulating jacket conductors of said cable means.

9. Apparatus for sensing and indicating the location of a "hot spot" along the length of a fire detecting cable means of the type having at least first and second longitudinally extending and spaced apart temperature sensing conductors having means for allowing a conduction path to be established between the two temperature sensing conductors in response to the presence of a temperature at any location along the length of the fire detecting cable means exceeding a predetermined temperature, and at least third and fourth longitudinally extending and spaced apart non-temperature sensing conductors each of which is covered with a non-conducting electrical insulating composition wherein each of said temperature sensing and non-temperature sensing conductors is of substantially identical length with one end of each of said conductors being defined as the NEAR END and the opposite end of each of said conductors being defined as the FAR END, said apparatus comprising:

linear stable voltage feedback loop electronic circuit means having input means coupled to the NEAR END of the fire detecting cable and having output means coupled to the FAR END of the fire detecting cable for maintaining through said third and fourth conductors a predetermined magnitude DC voltage potential between the NEAR END end and the FAR END end of said first one of the temperature sensing conductors of said fire detecting cable means;

a first DC voltage reference potential power source means for supplying said predetermined magnitude DC voltage potential, and voltage measurement means coupled to the NEAR END ends of the first and second ones of the temperature sensing conductors of said fire detecting cable means for sensing and measuring a voltage potential developed between said NEAR END end of said first one of said temperature sensing conductors of said fire detecting cable means and the "hot spot" when the temperature exceeds the predetermined temperature to establish the conduction path between the first and second conductors at the "hot spot" whereby the proportionality of the measured voltage to the predetermined magnitude of said DC voltage reference potential is directly indicative of the distance along said fire detecting cable means from the NEAR END to the location of the "hot spot".

10. Method for sensing and indicating the location of a "hot spot" along the length of a temperature sensing cable means of the type having at least first and second longitudinally extending and spaced apart conductors covered with an electrically insulating jacket having a composition which exhibits a resistance element characteristic and becomes electrically conductive when the temperature of the insulating jacket at any location along its surface exceeds a predetermined temperature and, at least third and fourth longitudinally extending and spaced apart conductors each of which is covered with a non-conducting electrical insulating jacket wherein each of said conductors is of substantially identical length with one end of each conductor being defined as the NEAR END and the opposite end of each conductor being defined as the FAR END, said method comprising:

the step of maintaining through said third and fourth conductors a predetermined magnitude DC voltage potential between the NEAR END end and the FAR END end of said first one of the electrically conductive insulating jacket conductors of said cable means utilizing a linear stable voltage feedback loop electronic circuit means having input means coupled to the NEAR END of the temperature sensing cable and having output means coupled to the FAR END of the temperature sensing cable;

the step of supplying said predetermined magnitude DC voltage potential, and the step of sensing and measuring a voltage potential developed across said first one of the electrically conductive insulating jacket conductors of said cable means and the "hot spot" utilizing voltage measurement means coupled to the NEAR END ends of the first second ones of the electrically conductive insulating jacket conductors of said cable means wherein said measured voltage potential is proportional to said predetermined magnitude of said DC voltage reference potential whereby the proportionality of the measured voltage to the predetermined magnitude of said DC voltage reference potential is directly indicative of the location of the "hot spot" along said temperature sensing cable means.

* * * * *